US006783419B1

(12) United States Patent
Paukert et al.

(10) Patent No.: US 6,783,419 B1
(45) Date of Patent: Aug. 31, 2004

(54) PLAYSET HAVING A RETRACTABLE TRACK SECTION

(75) Inventors: William M. Paukert, Providence, RI (US); Douglas A. Schultheis, Cumberland, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 10/655,444

(22) Filed: Sep. 4, 2003

(51) Int. Cl.[7] ..... A63H 33/00
(52) U.S. Cl. ..... 446/75; 446/444
(58) Field of Search ..... 446/75, 76, 77, 446/429, 430, 431, 444, 445

(56) References Cited

U.S. PATENT DOCUMENTS

| | | | | | |
|---|---|---|---|---|---|
| 3,209,491 | A | | 10/1965 | Roeper | 46/243 |
| 4,251,949 | A | * | 2/1981 | Buck et al. | 446/444 |
| 4,285,157 | A | | 8/1981 | Lambert | 46/202 |
| 4,388,036 | A | * | 6/1983 | Okamoto | 414/537 |
| 4,425,735 | A | | 1/1984 | Kulesza et al. | 46/202 |
| 4,433,504 | A | * | 2/1984 | Terui | 446/75 |
| 4,516,953 | A | | 5/1985 | Hippely et al. | 446/444 |
| 4,558,867 | A | | 12/1985 | Hippely | 273/412 |
| 4,575,350 | A | | 3/1986 | Hippely et al. | 446/368 |
| 4,937,207 | A | | 6/1990 | Simmell et al. | 446/75 |
| 5,052,972 | A | * | 10/1991 | Suimon et al. | 446/429 |
| 5,299,969 | A | | 4/1994 | Zaruba | 446/429 |
| 5,931,099 | A | * | 8/1999 | Bruner et al. | 104/53 |
| 6,358,112 | B1 | | 3/2002 | Lambert et al. | 446/429 |

* cited by examiner

*Primary Examiner*—Jacob K. Ackun, Jr.
(74) *Attorney, Agent, or Firm*—Marshall, Gerstein & Borun LLP

(57) ABSTRACT

A playset for use with a wheeled toy vehicle includes a flexible first track section defining a first part of a path for the toy vehicle, a rigid and looped second track section defining a second part of the path, and a cavity formed in the second track section sized to permit the first track section to be shifted between an extended position and a retracted position. The first part of the path and the second part of the path are aligned when the first track section is in the extended position, and at least a major portion of the first track section is disposed within the cavity of the second track section when the first track section is in the retracted position.

20 Claims, 9 Drawing Sheets

PLAYSET HAVING A RETRACTABLE TRACK SECTION

BACKGROUND OF THE INVENTION

The present invention is directed to a playset for use with toy vehicles, such as spring powered toy vehicles. More specifically, the present invention is directed toward a playset having a fixed track section and a retractable track section, with the retractable track section arranged for storage within the fixed track section when not in use.

Playsets for toy vehicles, including spring powered toy vehicles, electrically or battery powered toy vehicles, and unpowered toy vehicles are known in the art. Many of these playsets typically include, for example, one or more track sections with a multitude of turns, loops, hills, crossovers, and/or other obstacles or features designed to enhance the play value of the toy vehicles.

U.S. Pat. No. 4,285,157 to Lambert discloses a toy racing set comprising a carrying case or housing 12, and a section of flexible track 26. The carrying case or housing 12 unfolds to form a portion of a track upon which a toy vehicle may run. The section of flexible track 26 may be attached directly to the housing 12 when the toy is in use, or may be detached from the housing 12 and stored inside the housing when the playset is not in use.

SUMMARY OF THE INVENTION

In one aspect, a playset for use with a wheeled toy vehicle includes a first track section defining a first part of a path for the toy vehicle, the first track section having an inlet end and an outlet end, and a second track section defining a second part of the path, where the second track section includes an inlet end and an outlet end and further includes a cavity. The first track section is shiftable between an extended position and a retracted position. The outlet end of the first track section is aligned with the inlet end of the second track section when the first track section is in the extended position such that the first and second portions of the path are contiguous. The first track section is disposed within the cavity of the second track section when the first track section is in the retracted position.

The first track section may be flexible, and the second track section may be rigid and further may be formed into a loop. The cavity may include an inlet generally adjacent the inlet end of the second track section, and a spring biased platform may be disposed adjacent the inlet of the cavity. The platform is arranged to bias a plane of the outlet end of the first track section to a position substantially coplanar with a plane of the inlet end of the second track section when the first track section is in the extended position.

The outlet end of the first track section may include a tab positioned to contact the platform when the first track section is in the extended position, and the plane of the first track section may be disposed above the tab. The tab may engage a stop defined adjacent the inlet end of the cavity, and the tab and the stop may be arranged to permit the tab to be released from the stop upon depressing the platform and/or the first track section. At least one internal guide may be provided to guide movement of the first track section within the cavity when the first track section is being shifted toward or away from the retracted position.

In another aspect, a playset for use with a wheeled toy vehicle includes a flexible first track section defining a first part of a path for the toy vehicle, a rigid and looped second track section defining a second part of the path, and a cavity formed in the second track section sized to permit the first track section to be shifted between an extended position and a retracted position. The first part of the path and the second part of the path are aligned when the first track section is in the extended position, and at least a major portion of the first track section is disposed within the cavity of the second track section when the first track section is in the retracted position.

In a further aspect, a playset comprises a wheeled toy vehicle, a flexible first track section defining a first path for the toy vehicle, a rigid second track section defining a second path for the toy vehicle, the second track section formed in a loop, and a cavity formed in the second track section arranged to permit sliding movement of the first track section between an extended position and a retracted position. The first path and the second path are aligned when the first track section is in the extended position, and a majority of the first track section is disposed within the cavity of the second track section when the first track section is in the retracted position. A spring biased platform may be provided, with the platform arranged to bias an outlet end of the first track section into a position in which the outlet end of the first path and an inlet end of the second path are coplanar when the first track section is in the extended position. A releasable stop carried by at least one of the first track section and the second track section is arranged to define at least in part the extended position.

DETAILED DESCRIPTION OF VARIOUS EMBODIMENTS

Figure 1:
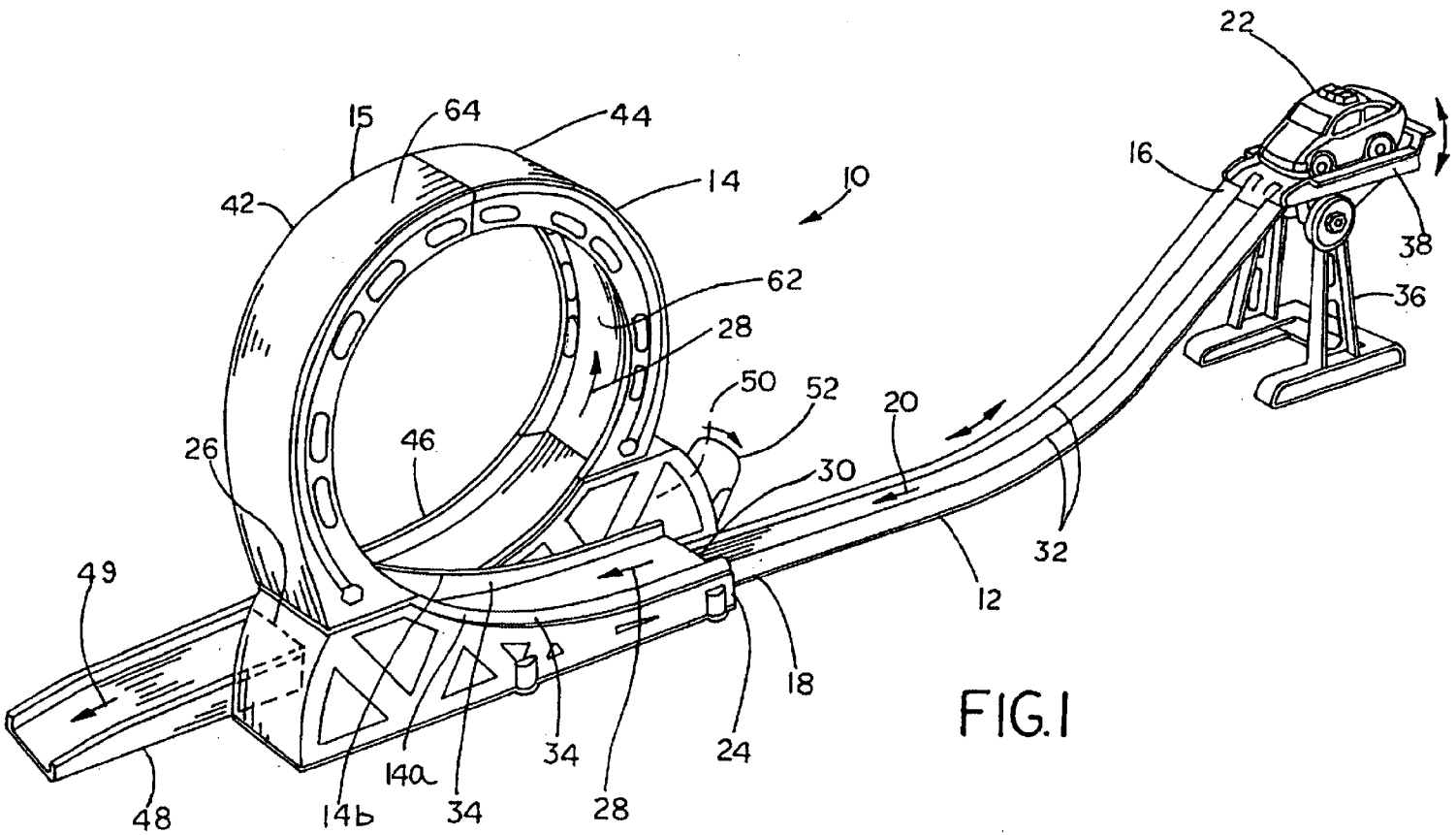
FIG. 1 is a perspective view of a playset having a fixed track section and a retractable track section and which has been assembled in accordance with the teachings of the present invention.
Figure 2:
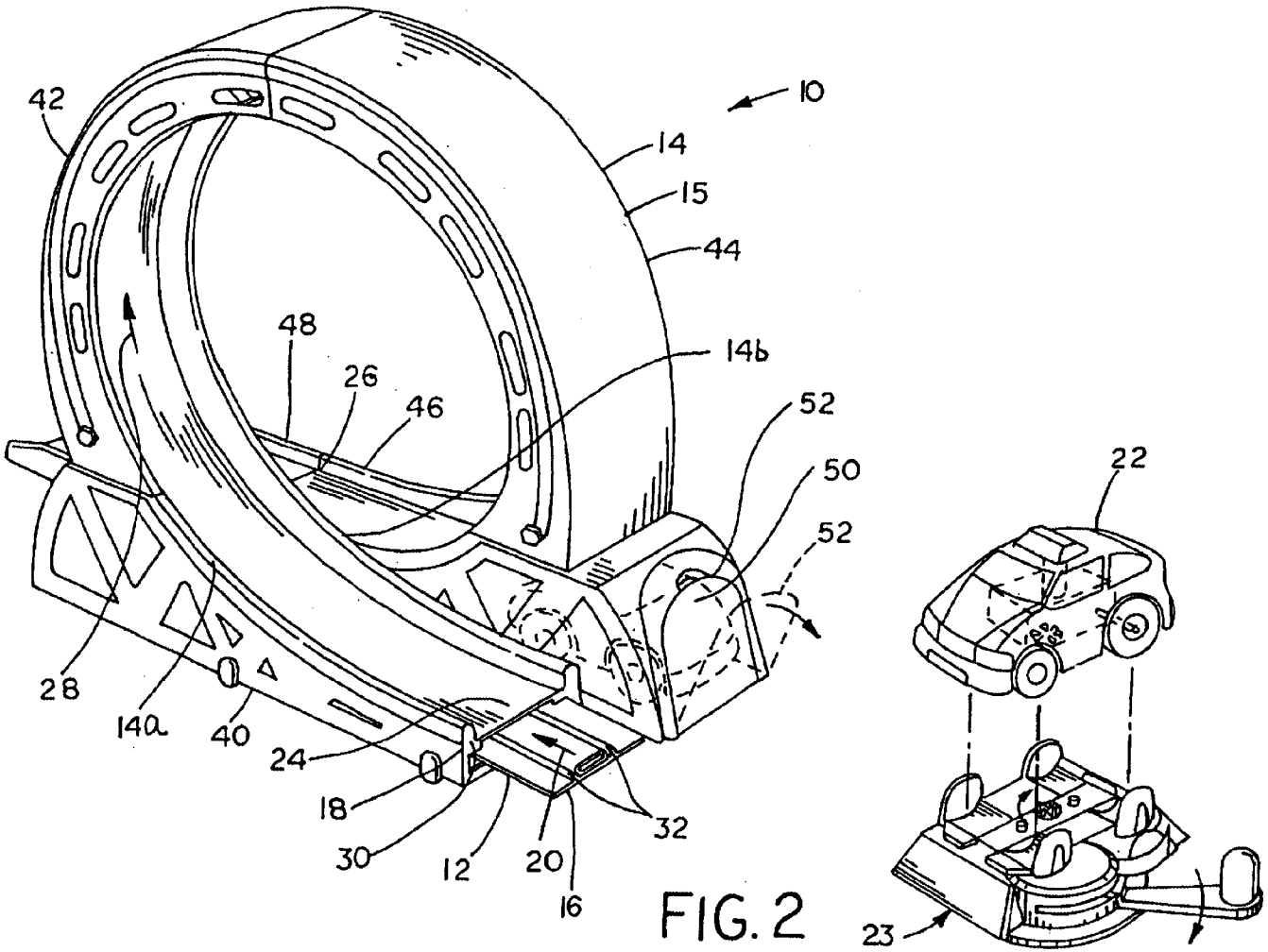
FIG. 2 is an enlarged view in perspective of the playset of FIG. 1 shown with the retractable track section being retracted into the fixed track section.

Referring now FIGS. 1 and 2 of the drawings, a playset for a toy vehicle constructed in accordance with the teachings of the present invention is shown and is generally referred to by the reference numeral 10. The playset 10 includes a first track section 12 and a second track section 14. The first track section 12 includes an inlet end 16 and an outlet end 18 (the outlet end 18 of the first track section 12 is visible in FIG. 1 but is concealed in FIG. 2), with the first track section 12 generally defining a path 20 for a wheeled toy vehicle 22. The second track section 14 includes an inlet end 24, an outlet end 26, and generally defines a path 28 extending between the inlet end 24 and the outlet end 26. It will be appreciated when viewing FIG. 1 that the paths 20 and 28 are contiguous or otherwise meet at an interface 30 when the track sections 12 and 14 are positioned as shown. The interface 30 is defined where the outlet end 18 of the first track section 12 meets the inlet end 24 of the second track section 14. The second track section 14, in the disclosed example, takes the form of a loop 15. Other suitable shapes may be chosen.

The first track section 12 may be provided with guides 32 which extend generally along the path 20. The guides 32 are arranged to help guide the toy vehicle 22 along the path 20 and, in the disclosed example, take the form of slightly raised ridges or ribs sized to make contact with the wheels or other parts of the toy vehicle 22. Ribs (not shown) disposed along the edges of the section 12 may also be suitable.

Similarly, the second track section 14 also may be provided with guides 34. In the disclosed example, the guides 34 take the form of raised edges or bumpers running along the sides 14*a* and 14*b* of the second track section 14, with the guides 34 also extending generally parallel to, or otherwise following, the path 28.

Further, in the disclosed example the playset 10 may be provided with an optional stand 36 having a platform 38, with the platform 38 being sized to receive the toy vehicle 22 until the toy vehicle 22 is ready for use by a user (not shown). In the event the toy vehicle 22 is spring powered, the playset 10 may be provided with a winder 23 (FIG. 1).

The second track section 14 may be constructed of a number of individual sections, such as, for example, the sections 40, 42, 44 and 46. It will be appreciated that the section 40 generally defines the inlet end 24 of the second track section 14, while the section 46 generally defines the outlet end 20 of the second track section 14. An outlet ramp 48 may be provided which attaches to the outlet end 26 of the second track section 14, so as to provide a relatively smooth transition from the playset 10 to a floor or other support surface. Alternatively, the ramp 48 may be connected to an additional piece or section of track (not shown). It will be appreciated that the ramp 48 defines a path 49 (best visible in FIG. 1) which, when the ramp 48 is attached to the second track section 14 as shown in FIG. 1, extends in a contiguous fashion with the path 28.

Each of the sections 40, 42, 44 and 46 may be constructed separately of, for example, high impact plastic or other suitable materials. Alternatively, the sections may be of unitary construction. Preferably, in the disclosed example, each of the sections 40, 42, 44 and 46 may be connected to each other using a snap-fit arrangement utilizing suitable snap-fit features such as tabs in slots or any other form of suitable connection of the type commonly employed in the art.

As shown in FIG. 2, the second track section 14 may be provided with an enclosure 50 having an openable door 52. The enclosure 50 is preferably sized so as to receive the toy vehicle 22. In the disclosed example, the enclosure 50 is defined in the section 46 of the second track section 14. As an alternative, the enclosure 50 may be defined in other portions of the second track section 14 as desired. Preferably, the door 52 may be provided with a suitable friction fit or snap-lock arrangement in order to maintain the door 50 in the closed position as shown in solid lines in FIG. 2. It will be understood that the door 52 may be shifted toward an open position as shown in dotted lines in FIG. 2.

Figure 3:
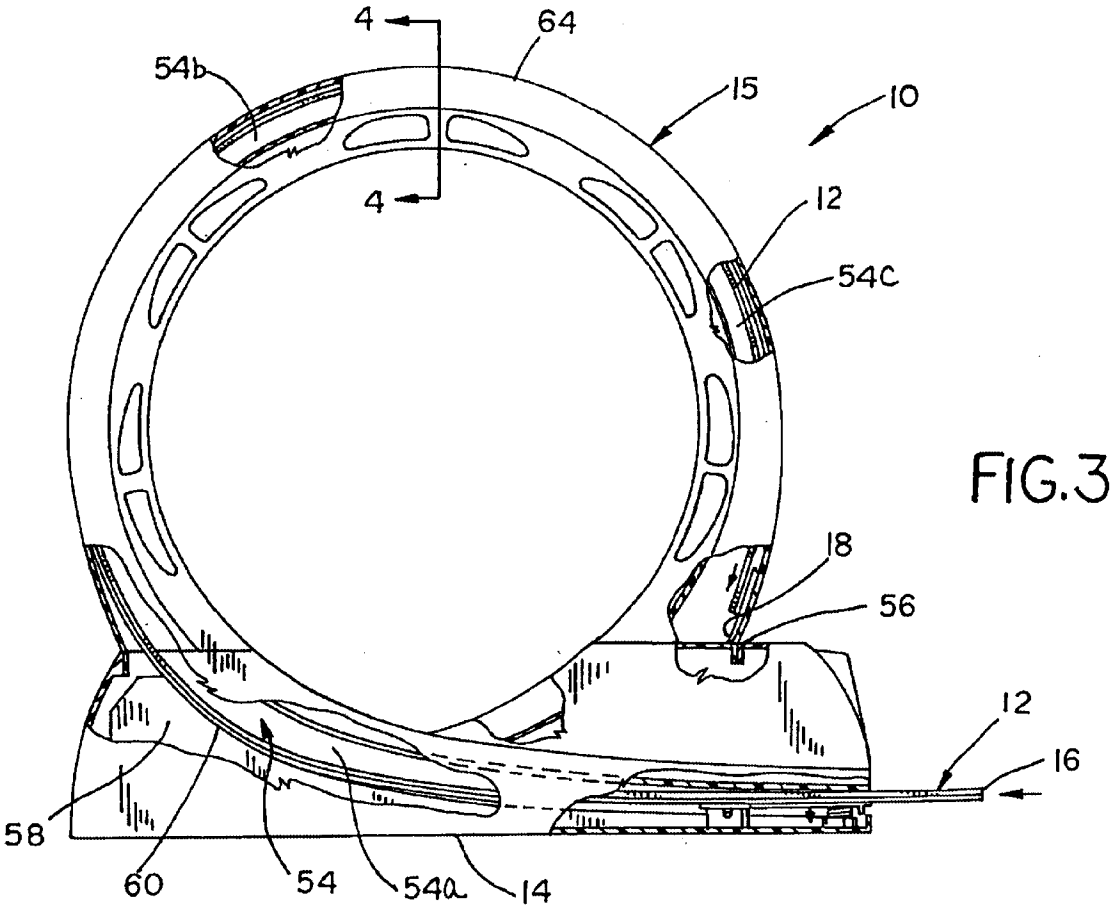
FIG. 3 is an enlarged elevational view, partly in section, of the retractable track section disposed inside the fixed track section.

Referring now to FIG. 3, the second track section 14 is shown therein in cross-section. A cavity 54 is defined in the second track section 14, with the cavity generally including three areas 54*a*, 54*b* and 54*c*. The area 54*a* is defined by the section 40 of the second track section 14, the area 54*b* is defined by the section 42 of the second track section 14, and the area 54*c* is defined by the section 44 of the second track section 14. The cavity 54 is sized to receive the first track section 12, and permits the first track section 12 to be shifted from an extended position, such as is shown in FIG. 1, to a retracted position, such as is shown in FIG. 3. It will be appreciated when viewing FIG. 3 that the inlet end 16 of the first track section 12 may protrude slightly from the cavity 54 when the first track section 12 is fully retracted into the second track section 14 so as to be readily graspable by a user (not shown). In further accordance with the disclosed example, the cavity 54 terminates prior to entering the section 46 of the second track section 14, with a suitable stop 56 being provided either at the end of the cavity 54 in the section 44 or on the section 46, with the stop 56 arranged and positioned to limit the movement of the outlet end 18 of the first track section 12 toward the fully retracted position. The section 40 may be provided with one or more shaped guides 58 (also visible in FIG. 5), each of which includes a surface 60 (also visible in FIG. 5) which directs the first track section 12 into the cavity 54*b* from the cavity 54*a* when the first track section 12 is being shifted toward the retracted position.

Figure 4:
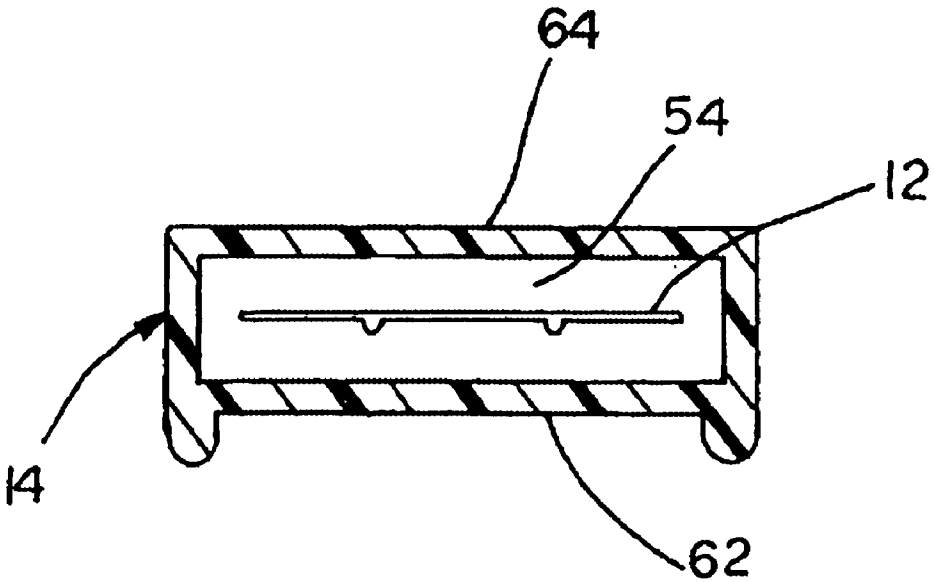
FIG. 4 is an enlarged cross-sectional view taken along line 4—4 of FIG. 3.

Referring now to FIG. 4, the second track section 14 is shown in cross-section, with the second track section 14 including a running surface 62 which generally runs along the path 28. The cavity 54 is shown disposed between the running surface 62 and an outer surface 64 of the loop 15 defined by the second track section 14.

Referring now to FIGS. 5–9, the section of 40 of the second track section 14 may be provided with a spring biased platform 66. The platform 66 includes a pair of pivots 68 which are sized to be received in suitable slots or apertures 70 to permit the platform 66 to pivot about the pivots 68 as will be discussed in greater detail below. The pivots 68 may be retained within their corresponding slots 70 by suitable caps 72. One or more springs 74 (viewable in FIGS. 5–6 and 8–9) or other suitable biasing means are provided which engage an underside 67 of the platform 66 in order to bias an end 76 of the platform generally upward when viewing FIGS. 5, 6 and 8.

Figure 5:
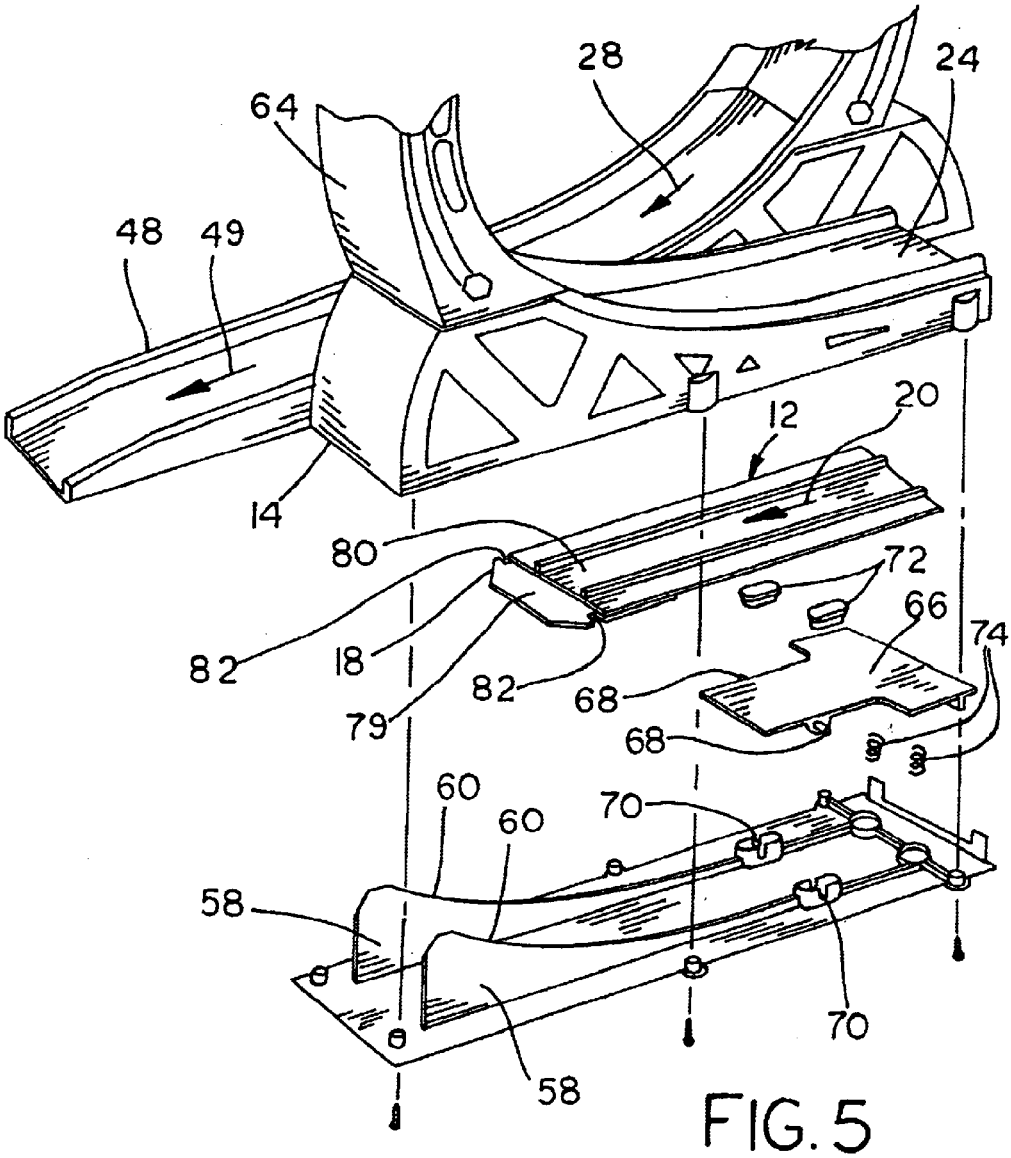
FIG. 5 is an enlarged fragmentary exploded view in perspective of the inlet portion of the fixed track section.
Figure 6:
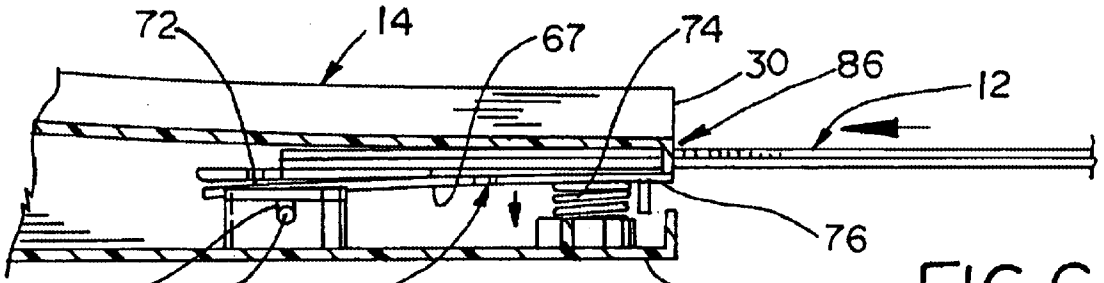
FIG. 6 is an enlarged fragmentary cross-sectional view of the inlet portion of the fixed track section illustrating the flexible track section in a partially retracted configuration.
Figure 7:
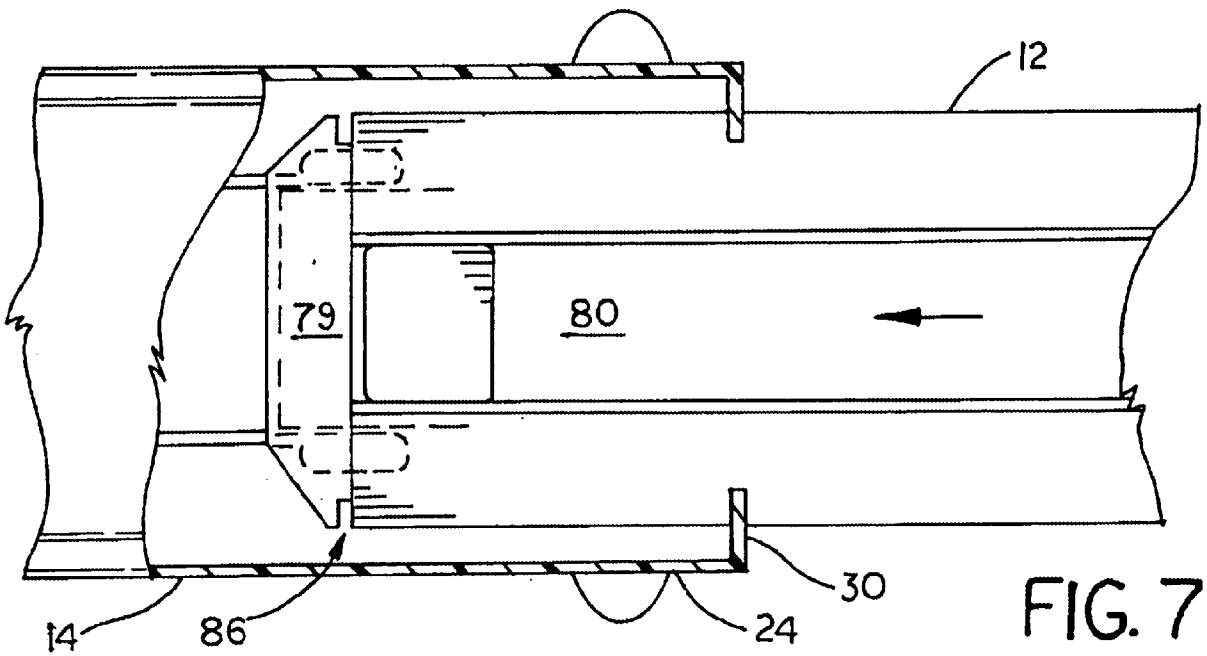
FIG. 7 is an enlarged fragmentary top plan view, partly in section, of the inlet portion of the fixed track section illustrating the flexible track section in the partially retracted configuration.
Figure 8:
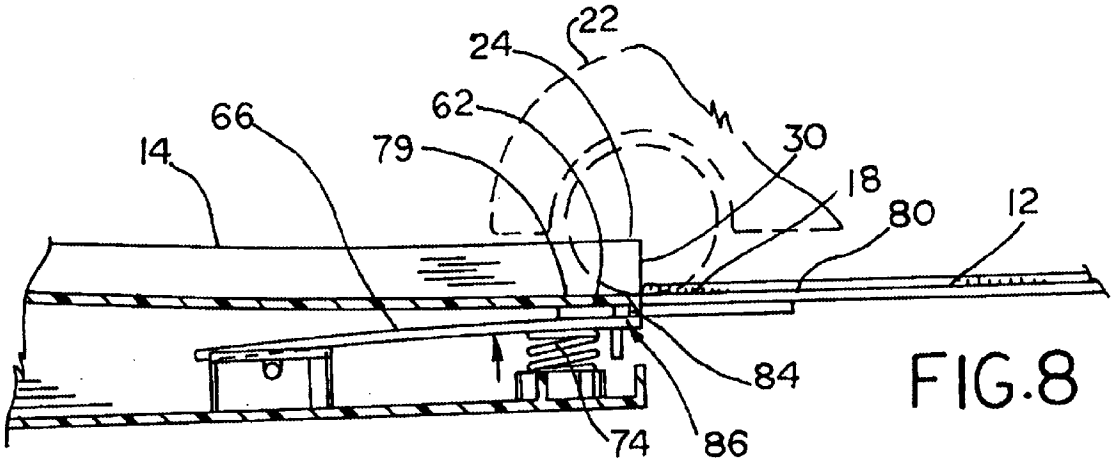
FIG. 8 is an enlarged fragmentary cross-sectional view of the inlet portion of the fixed track section illustrating the flexible track section in a fully extended configuration.
Figure 9:
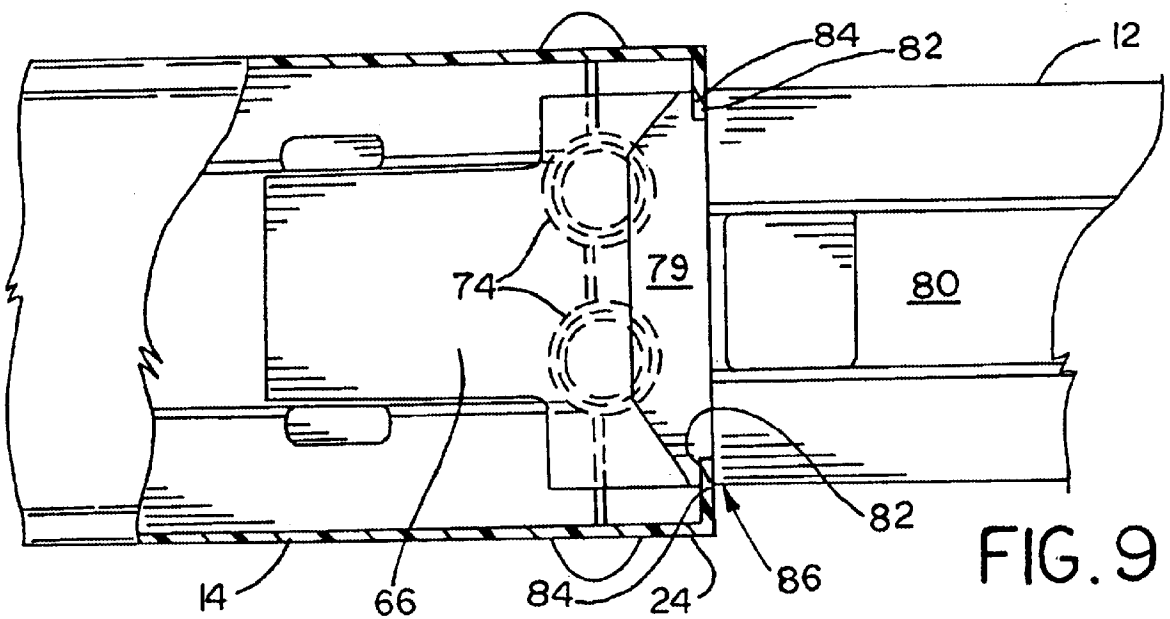
FIG. 9 is an enlarged fragmentary top plan view of the inlet portion of the fixed track section illustrating the flexible track section in the fully extended configuration.
Figure 10:
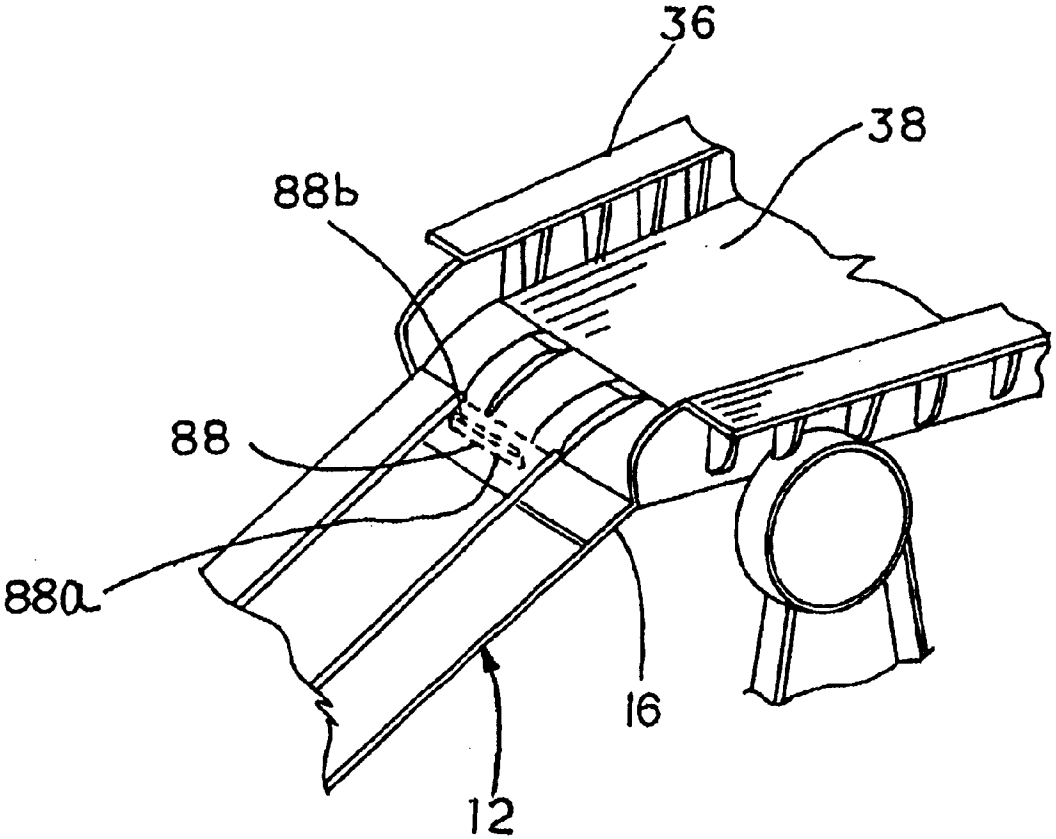
FIG. 10 is an enlarged fragmentary view in perspective of the inlet end of the flexible track section attached to an optional accessory, such as a raised stand.

As is shown in FIGS. 5–9, the outlet end 18 of the first track section 12 may be provided with a tab 78. it will be noted when viewing FIGS. 5 and 6 that an upper surface 79 is preferably disposed below a plane defined by an upper surface 80 of the first track section 12. Accordingly, when viewing FIG. 8, it will be understood that the plane defined by the upper surface 80 of the first track section 12 will be disposed so as to be coplanar with a plane defined by the running surface 62 of the second track section 14. Thus, a smooth transition between the path 20 and the path 28 is achieved at the interface 30 between the first track section 12 and the second track section 14 when the first track section is in the fully extended position as shown in FIGS. 1, 8 and 9.

Referring now to FIGS. 5 and 9, the outlet end 18 of the first track section 12 may be provided with a pair of notches 82. The inlet end 24 of the second track section 14 preferably includes a pair of protrusions or ribs 84 sized for engagement by the notches 82. The notches 82 and the ribs 84 cooperate to define a releasable stop 86, which, in the disclosed example, prevents the first track section 12 from being inadvertently detached from the second track section 14 when the first track section 12 is being shifted toward the fully extended position.

It will be appreciated, in the disclosed example, that the stop 86 may be released by depressing the end 76 of the platform 66 against the force of the springs 74, thus enabling the notches 82 to be disengaged from the ribs 84 and thereby permitting the first track section 12 to be either fully disengaged from the second track section 14 or otherwise to be shifted back into or toward the retracted position.

Figure 11:
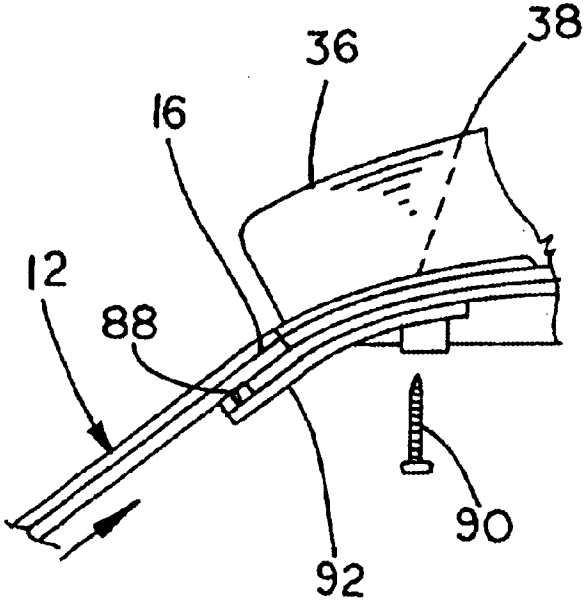
FIG. 11 is a fragmentary elevational view thereof.
Figure 12:
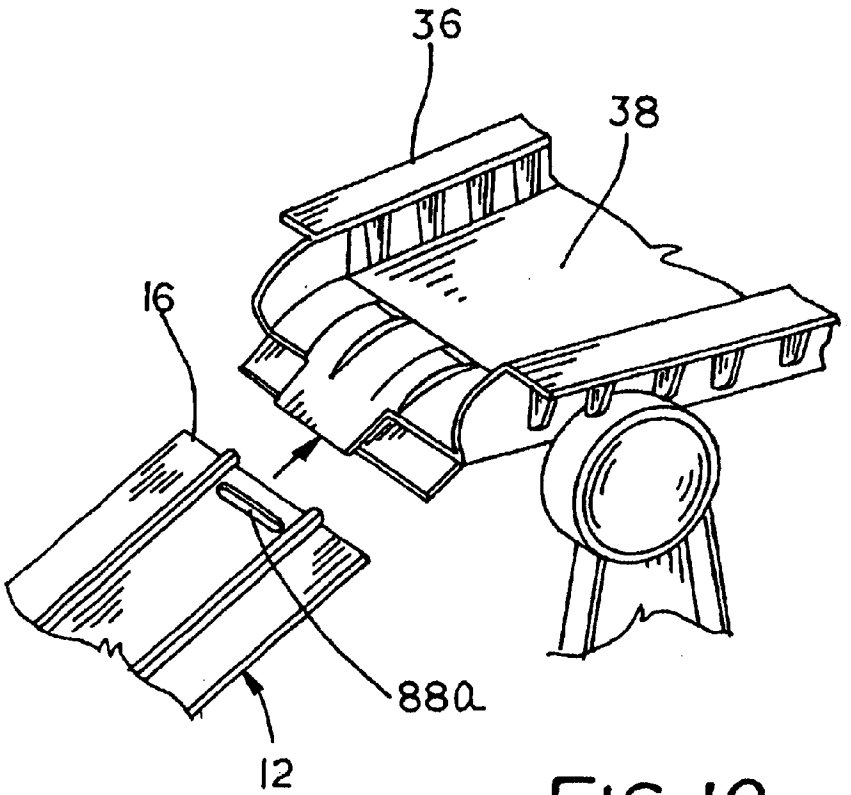
FIG. 12 is an enlarged fragmentary view in perspective similar to FIG. 8 but illustrating the flexible track section detached from the optional raised stand.
Figure 13:
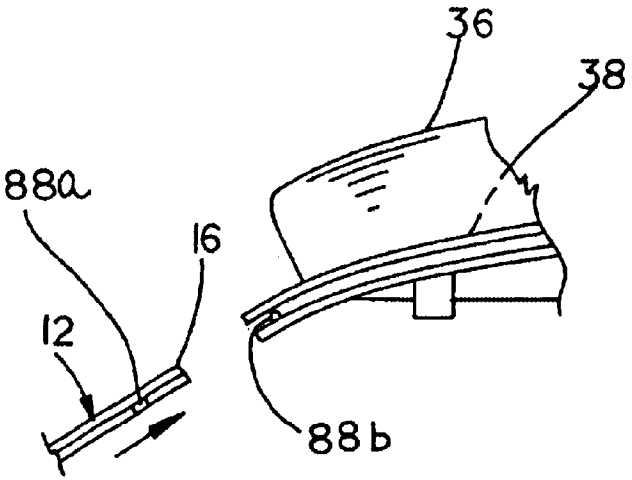
FIG. 13 is a fragmentary elevational view thereof.

Referring now to FIGS. 10–13, the inlet and 16 of the first track section 12 may be secured to the optional stand 36 as shown. This attachment may be achieved by a suitable tab-in-slot connection 88 having a slot 88*a* in the track section 12 and a tab 88*b* formed in the stand 36, or by any other suitable means. As shown in FIG. 11, the connection 88 may be secured using a screw 90 which holds a removable plate 92, with the plate 92 having formed thereon the tab 88*b*.

In operation, the playset at 10 may be transported and/or stored with the first track section 12 disposed almost entirely within the cavity 54 of the second track section 14. Additionally, the toy vehicle 22 may be housed within the storage area 50 as discussed above. Once a user desires to use the playset 10, the user may grasp the protruding end of the first track section (i.e., the inlet end 16 of the first track section 12 which protrudes from the second track section 14 when the first track section 12 is in the retracted position). By pulling the first track section 12, the first track section 12 is uncoiled from the retracted position disposed within the second track section 14 until the first track section 12 reaches the fully extended position of FIG. 1. As the first track section 12 approaches this fully extended position, the upward force of the spring biased platform 66 causes the first track section 12 to stop when the notches 82 engage the ribs 84. When this happens, the spring biased platform 66 urges the upper surface 80 of the first track section 12 upwardly so that the surfaces of the first and second track sections 12, 14 are coplanar at the interface 30 between the respective track sections.

When it is desired to shift the first track section 12 back into the retracted positioned disposed within the second track section 14, the user depresses the outlet end 18 of the first track section 12 downwardly against the upwardly biasing force of the platform 66. This downward movement of the first track section 12 permits the outlet end 18 of the first track section 12 to be disposed below the plane of the second track section 14, thereby permitting the first track section 12 to be pushed into the cavity 54 and into the fully retracted position.

The first track section 12 may be constructed of a suitable flexible plastic material of the type commonly employed in the art, such that the first track section 12 will be readily deformable as required in order to be conveniently positioned inside the second track section 14 as discussed above. The second track section 14 may be constructed of a suitable high impact plastic material of the type commonly employed in the art, and further may be constructed in one or more sections as discussed above, or in any other convenient fashion. Further, the playset 10 may take a variety of forms. For example, instead of a loop, the playset 10 may be straight, curved, or may be formed in any other suitable configuration, and may include additional pieces and/or components as desired by a user and/or a toy designer.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A playset for use with a wheeled toy vehicle, comprising:

a first track section defining a first part of a path for the toy vehicle, the first track section having an inlet end and an outlet end;

a second track section defining a second part of the path, the second track section having an inlet end and an outlet end;

the second track section including a cavity; and the first track section shiftable between an extended position and a retracted position; the outlet end of the first track section being aligned with the inlet end of the second track section when the first track section is in the extended position such that the first and second portions of the path are contiguous, the first track section being disposed within the cavity of the second track section when the first track section is in the retracted position.

2. The toy of claim 1, wherein the first track the section is flexible.

3. The toy of claim 2, wherein the second track section is rigid.

4. The toy of claim 3, wherein the second track section is formed in a loop.

5. The toy of claim 1, wherein the cavity includes an inlet generally adjacent the inlet end of the second track section, and further including a spring biased platform disposed adjacent the inlet of the cavity, the platform arranged to bias a plane of the outlet end of the first track section to a position substantially coplanar with a plane of the inlet end of the second track section when the first track section is in the extended position.

6. The toy of claim 5, wherein the outlet end of the first track section includes a tab positioned to contact the platform when the first track section is in the extended position.

7. The toy of claim 6, wherein the plane of the first track section is disposed above the tab.

8. The toy of claim 5, wherein fee outlet and of the first track section includes a tab sized for placement and the cavity one the first track section is in the extended position.

9. The toy of claim 8, wherein the tab is arranged to engage a stop defined adjacent the inlet end of the cavity.

10. The toy of claim 9, wherein the tab and the stop are arranged to permit the tab to be released from the stop upon depressing the platform.

11. The toy of claim 1, wherein the cavity includes at least one internal guide shaped and positioned to guide movement of the first track section within the cavity when the first track section is being shifted toward or away from the retracted position.

12. A playset for use with a wheeled toy vehicle, comprising:

a flexible first track section defining a first part of a path for the toy vehicle;

a rigid second track section defining a second part of the path, the second track section formed in a loop;

a cavity formed in the second track section, the cavity sized to permit the first track section to be shifted between an extended position and a retracted position, the first part of the path and the second part of the path being aligned when the first track section is in the extended position, at least a major portion of the first track section being disposed within the cavity of the second track section when the first track section is in the retracted position.

13. The toy of claim 12, wherein the cavity includes an inlet generally adjacent an inlet end of the second track section, and further including a spring biased platform disposed adjacent the inlet of the cavity, the platform arranged to bias an outlet end of the first track section into a position coplanar with the inlet end of the second track section when the first track section is in the extended position.

14. The toy of claim 13, wherein the outlet end of the first track section includes a tab positioned to bear against an upper surface of the platform when the first track section is in the extended position.

15. The toy of claim 14, wherein the plane of the first track section is disposed above the tab.

16. The toy of claim 12, wherein an outlet end of the first track section is arranged to engage a stop defined adjacent an inlet end of the second track section.

17. The toy of claim 12, wherein the stop is releasable, thereby permitting the first track the section to be detached from the second track the section.

18. The toy of claim 12, wherein the cavity includes at least one internal guide shaped and positioned to guide movement of the first track section within the cavity when the first track section is being shifted toward or away from the retracted position.

19. The toy of claim 12, the playset including a toy vehicle, and wherein the second track section includes a storage area sized to receive the toy vehicle.

20. A playset comprising:

a wheeled toy vehicle;

a flexible first track section defining a first path for the toy vehicle;

a rigid second track section defining a second path for the toy vehicle, the second track section formed in a loop;

a cavity formed in the second track section, the cavity arranged to permit sliding movement of the first track section between an extended position and a retracted position, the first path and the second path being aligned when the first track section is in the extended position, a majority of the first track section being disposed within the cavity of the second track section when the first track section is in the retracted position;

a spring biased platform arranged to bias an outlet end of the first track section into a position in which the an outlet end of the first path and an inlet end of the second path are coplanar when the first track section is in the extended position; and a releasable stop carried by at least one of the first track section and the second track section, the stop arranged to define at least in part the extended position.

* * * * *